US005176484A

United States Patent [19]

Kuperman et al.

[11] Patent Number: 5,176,484

[45] Date of Patent: Jan. 5, 1993

[54] MULTI-STOREY DEPOT FOR STORING CARGO AND AUTOMOBILES

[76] Inventors: Eric Kuperman, 42 Longwood Ave., Brookline, Mass. 02146; Ira Tatelbaum, 47 Gardner Rd., Quincy, Mass. 02169; Alexander A. Nasedkin, Leninsky Prosp. 62, Ap233, 117296 Moscow, U.S.S.R.; Oleg I. Mukan, Stroitelei U1 11, Ap82, 117311 Moscow, U.S.S.R.; Victor S. Altshuler, Entuziastov Sh96, Ap386, 111531 Moscow, U.S.S.R.

[21] Appl. No.: 864,179

[22] Filed: Apr. 3, 1992

Related U.S. Application Data

[63] Continuation of Ser. No. 499,324, filed as PCT/US89/05448, Dec. 11, 1989, abandoned.

[30] Foreign Application Priority Data

Dec. 16, 1988 [SU] U.S.S.R. ..... 4629889
Jun. 30, 1989 [SU] U.S.S.R. ..... 4711772

[51] Int. Cl.[5] ..... E04H 6/18

[52] U.S. Cl. ..... 414/240; 414/234; 414/236

[58] Field of Search ..... 104/130, 130.1, 131, 104/132, 127, 128, 129, 48; 414/227, 231-240, 261, 262, 286; 198/468.6

[56] References Cited

U.S. PATENT DOCUMENTS

| | | | |
|---|---|---|---|
| 1,782,410 | 11/1930 | Cook | 414/237 |
| 1,811,545 | 6/1931 | Goddard | 414/237 |
| 2,024,190 | 12/1935 | Sumi et al. | 414/238 |
| 2,201,939 | 5/1940 | Auger et al. | 104/48 X |
| 2,216,637 | 10/1940 | Auger et al. | 104/48 X |
| 2,598,750 | 6/1952 | Bargehr | 104/48 X |
| 2,602,557 | 7/1952 | Sinclair | 104/48 X |
| 2,617,700 | 11/1952 | Christie et al. | 414/236 X |
| 2,626,718 | 1/1953 | Weber | 104/48 X |
| 2,712,875 | 7/1955 | Leopold | 414/236 X |
| 2,762,489 | 9/1956 | O'Sullivan | 414/236 X |
| 2,823,810 | 2/1958 | Stoner | 414/239 |
| 2,837,224 | 6/1958 | Rosen | 414/236 |
| 2,849,126 | 8/1958 | Kerekes | 104/132 X |
| 2,899,086 | 8/1959 | Thaon De Saint André | 414/233 X |
| 2,930,497 | 3/1960 | Wheeler | 414/234 X |
| 2,943,725 | 7/1960 | Hohman | 414/235 |
| 3,035,717 | 5/1962 | Stone | 414/234 X |
| 3,085,700 | 4/1963 | O'Sullivan | 414/234 X |
| 3,294,260 | 12/1966 | Frangos | 414/239 |
| 3,356,040 | 12/1967 | Fonden | 104/130 |
| 3,581,914 | 6/1971 | Bosco | 414/238 |
| 3,710,957 | 1/1973 | Small | 414/239 |
| 3,715,992 | 2/1973 | Park | 104/130 X |
| 3,896,736 | 7/1975 | Hamy | 104/131 X |
| 3,915,094 | 10/1975 | Sawada et al. | 104/130 |
| 4,004,654 | 1/1977 | Hamy | 104/127 X |
| 4,167,365 | 9/1979 | Constantinescu | 414/239 |
| 4,259,907 | 4/1981 | Schuck | 104/48 |
| 4,322,804 | 3/1982 | Evans | 414/232 X |
| 4,470,742 | 9/1984 | Schindler | 414/286 |
| 4,768,914 | 9/1988 | Sing | 414/239 X |
| 4,869,634 | 9/1989 | Carter | 414/240 |

FOREIGN PATENT DOCUMENTS

| | | | |
|---|---|---|---|
| 109459 | 5/1984 | European Pat. Off. | 104/130 |
| 246014 | 11/1987 | European Pat. Off. | 414/227 |
| 14306 | 8/1956 | Fed. Rep. of Germany | 104/130 |
| 2748808 | 5/1978 | Fed. Rep. of Germany | 414/234 |
| 2910867 | 9/1980 | Fed. Rep. of Germany | 104/130 |
| 1293625 | 4/1962 | France | 414/239 |
| 598509 | 10/1959 | Italy | 414/237 |
| 0009274 | 1/1977 | Japan | 414/233 |
| 0085076 | 7/1978 | Japan | 414/234 |
| 0262306 | 10/1988 | Japan | 414/231 |
| 367973 | 4/1963 | Switzerland | 414/237 |
| 963154 | 7/1964 | United Kingdom | 104/130 |
| 977720 | 12/1964 | United Kingdom | 104/127 |
| 1086293 | 10/1967 | United Kingdom | 104/130 |

*Primary Examiner*—David A. Bucci
*Assistant Examiner*—Robert S. Katz
*Attorney, Agent, or Firm*—Wolf, Greenfield & Sacks

[57] ABSTRACT

A cargo depot for storing palletized cargoes such as passenger cars (97, 98, and 99), in which a car (97) is moved to a designated cell (5) in sequential steps along two or three coordinates through door openings (11, 12) provided in adjacent cells (5) located along the travelling path of the car (97). The adjacent cells (5) are emptied of other cargo by moving the cargo to other cells (5) to allow passage of the car (97).

13 Claims, 17 Drawing Sheets

MULTI-STOREY DEPOT FOR STORING CARGO AND AUTOMOBILES

This application is a continuation of application Ser. No. 07/499,324, filed as PCT/US89/05448, Dec. 11, 1989, now abandoned.

FIELD OF THE INVENTION

The present invention relates to the field of warehousing and civil engineering, and more specifically, to the ways and means of automated storage of palletized cargoes, containers and particularly passenger cars, i.e. to multi-storey automated garages that can be adapted to any architectural environment to occupy as little space as possible.

BACKGROUND OF THE INVENTION

Normally, a multi-storey garage that can be used for storage of cargoes features an elevator and cells in a high-rise or silo arrangement (see U.S. Pat. No. 3,330,083). The rows of cells form sections. The process of storage consists in lifting the cargo along a special shaft and placing it on a respective shelf (bottom of the cell).

The throughput of such a garage is limited, since other vehicles or containers are kept waiting while the elevator is occupied by one piece of cargo. The elevator shaft is used exclusively for moving cargoes (cars), thereby adding extra space to the garage. A person wishing to recover his (her) car will have to wait for the elevator to come up for the car and then come down, thus increasing the average waiting time. And, finally, failure of the elevator will make it impossible to load and unload, retrieve or park the car.

Also known in the art are more efficient ways of storage and multi-storey garages of greater capacity, wherein the sections are interconnected by running ways on which travel two to three stacker cranes, so that the loading process is two-dimensional (see UK Patent No. 2167394 or No. 2175575). However, these methods and the depots (garages) based thereon possess the same essential drawbacks (low throughput, low packing density of cargoes or vehicles leading to excessive floor space requirements, low reliability). It should also be noted that known garages have a rigid structure which prevents them from being fitted in between building, built up or partially dismounted.

Therefore, the primary object of the present invention is to permit compact arrangement of cargoes (vehicles).

Another object of the present invention is to increase the efficiency of the method and, consequently, the throughput of the depot (garage) and reduce the waiting time.

Still another object of the invention is to improve the reliability of the garage (depot) by ensuring its normal functioning even in the case of partial failure of the equipment.

A further object of this invention is to all the depot (garage) to be realized in any architectural design, i.e. to ensure flexibility of construction.

An additional object of the present invention is to improve the fire safety of the depot (garage) by localizing the source of the fire.

Another additional object of this invention is to raise the level of automation by providing the means for controlling the movement of cargoes either by a single operator or by fully automatic facilities.

Still another additional object of the present invention is to enhance the repairability of the garage by making provisions for correcting any malfunction without interfering with the process of loading and unloading.

A further additional object of the present invention is to prevent unauthorized access to the cargo (car) as a safeguard against larceny and vandalism.

BRIEF DESCRIPTION OF THE INVENTION

Accordingly, the object of the present invention is to provide an extremely compact, cost-effective and reliable depot (garage) with a high level of automation and minimum waiting time.

This object is achieved by resorting to a novel method of arrangement and movement of cargoes (passenger cars). The items of cargo are arranged in cells forming the structure of the garage and located in random order. The cells are completely identical and may be added or removed during operation of the garage. As a result, the depot (garage) has a flexible modular design and the cargo (car) placed in the cell may be moved in several (one, two or three) directions, in several coordinates. For this purpose, each cell is provided with corresponding pairs of door openings, coordinate guides and a coordinate drive. This makes it possible to interchange adjacent cargoes (cars), set up the long-term and short-term storage areas, set up the cargo flows within the depot (garage) in order to ensure timely delivery of a definite cargo in accordance with the schedule. The flow of cargo in such a depot (garage) is controlled by a microcomputer (microprocessor) and its configuration is continuously changed to optimize the arrangement of cargoes, i.e. to ensure minimum waiting time, save energy and to meet other demands programmed into the microprocessor. At the same time, an operator can exercise manual control over the flow of cargoes (cars), monitoring the movement thereof on the display of the control console.

In the following, there will be described two preferred embodiments of the depot (garage) i.e. with and without the use of pen (module) for the cargo (car). Both embodiments are characterized by the incorporation of a two-coordinate drive in each cell and differ in the design of the drive and the guides. It should be borne in mind, however, that a depot (garage) may be provided with a drive, guides and door openings for a third coordinate in each or several specially allotted cells, making it possible to expand the functional capabilities of the depot (garage). On the other hand, a skeleton construction may utilize a number of cells in the function of a cassette store with single-coordinate movement. The above-mentioned constructions may be combined within a single depot (garage).

Other object and features of the present invention will become apparent from the following description.

BRIEF DESCRIPTION OF THE DRAWINGS

In FIGS. 1 through 8, relative dimensions are shown true to scale so that the overall design of the depot (garage) can be readily visualized. Following graphic materials are more schematized but are also more detailed to provide a comprehensive illustration of the realization of the invention.

So.

FIGS. 15 and 16 depict a module, while

PREFERRED EMBODIMENTS OF THE INVENTION

First, consider the embodiment of a depot (garage) shown in FIGS. 1 through 19.

Figure 1:
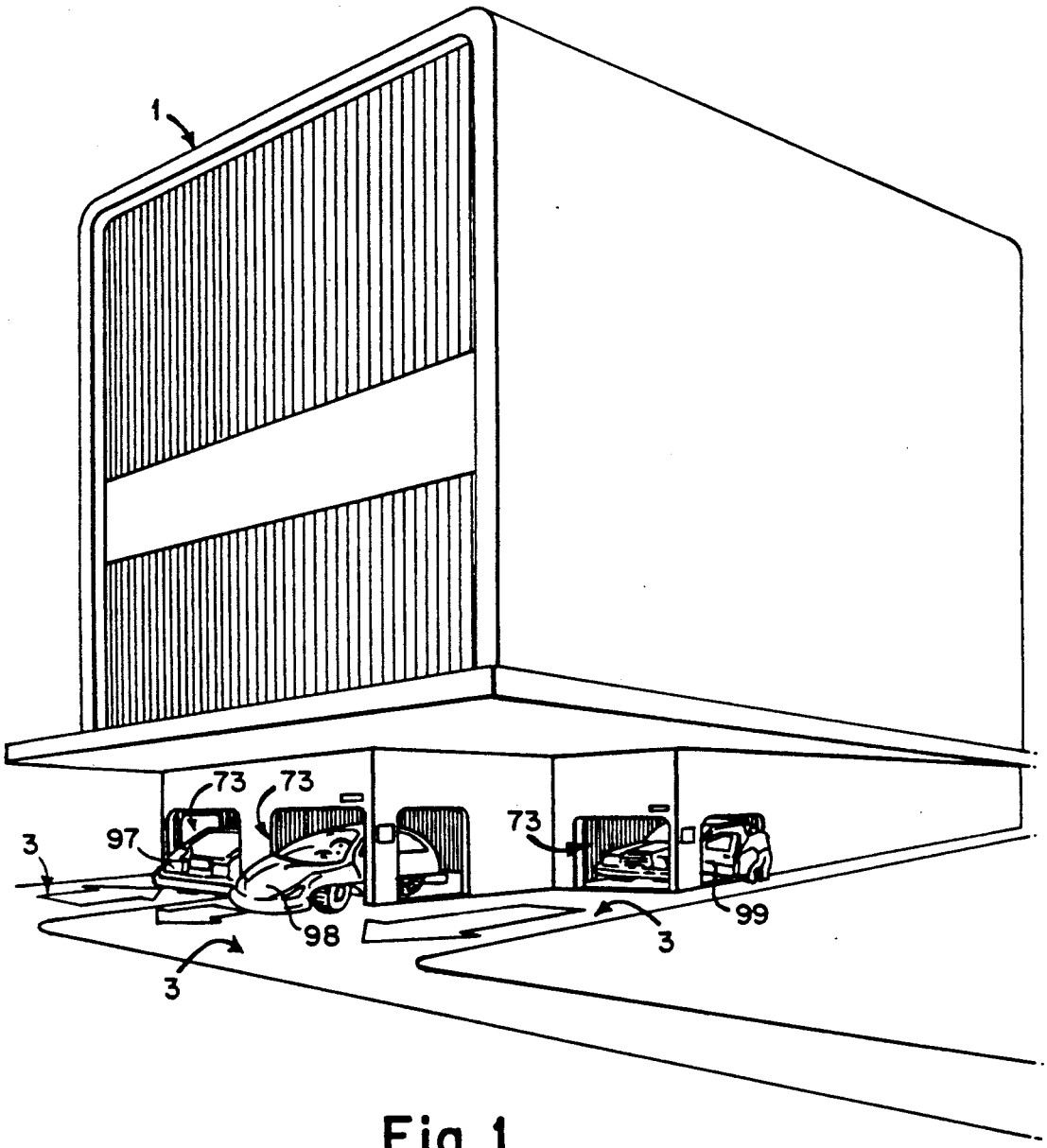
FIG. 1 shows an external view of the building of a depot (garage) which can be erected as a separate structure at, say, an airport.
Figure 2:
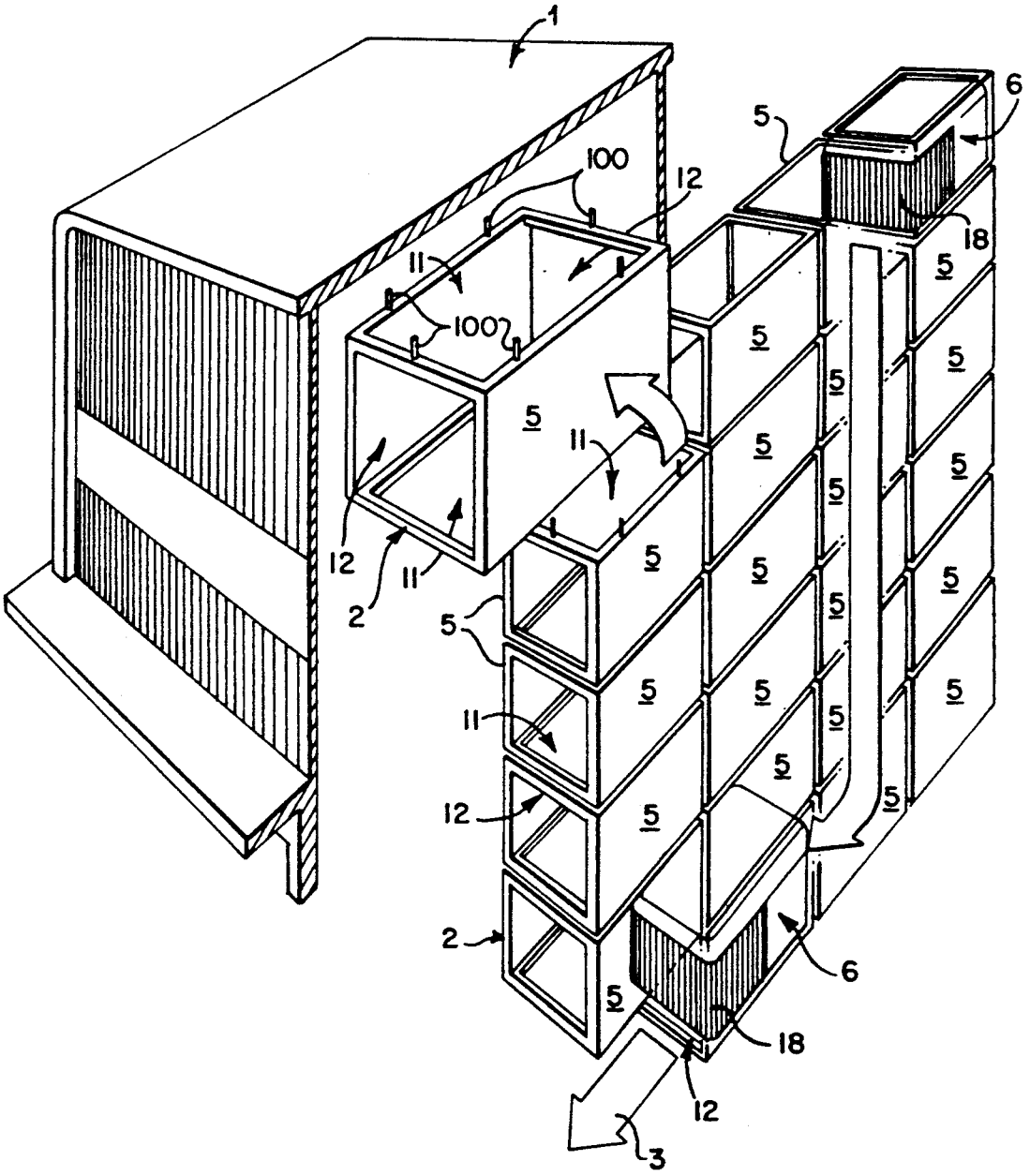
FIG. 2 illustrates installation of a cell in a section.
Figure 3:
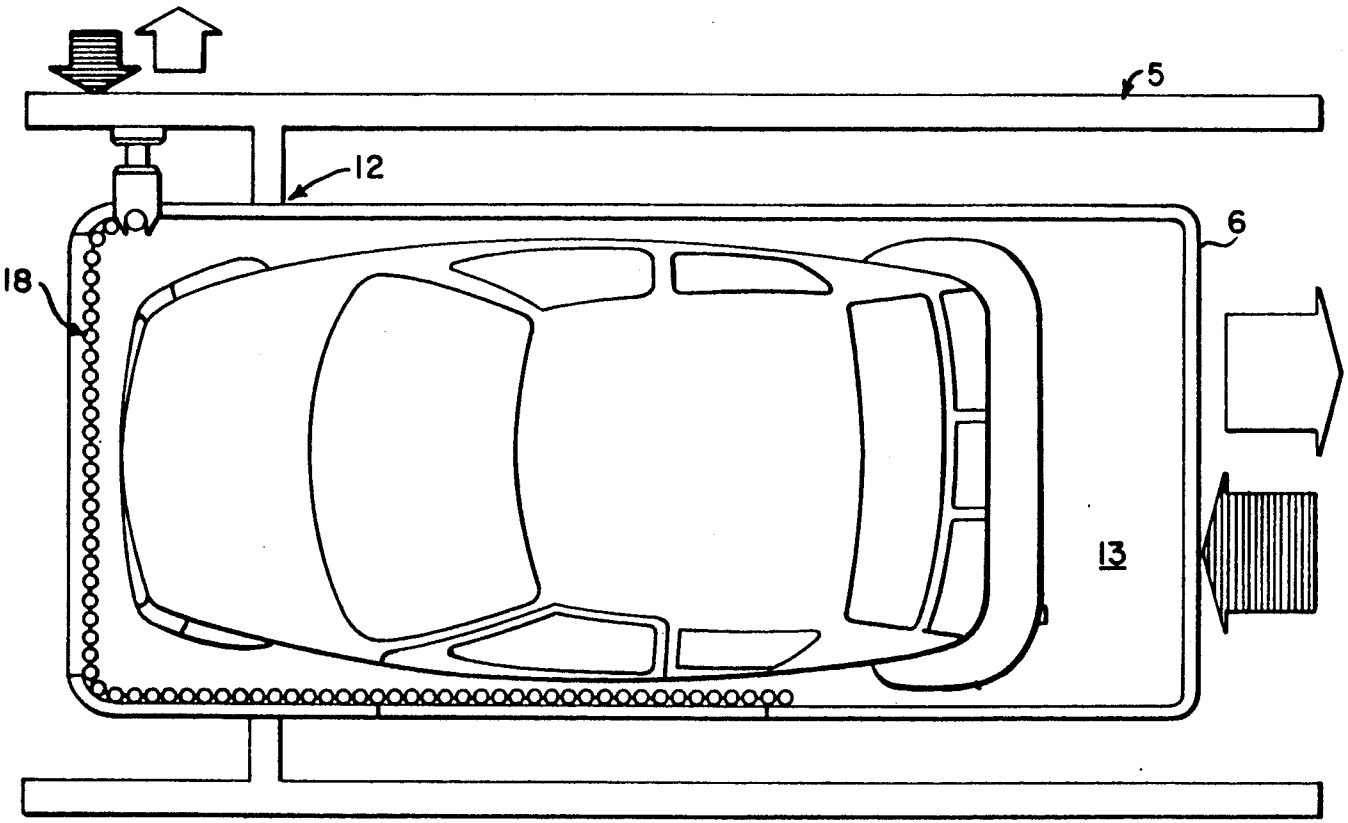
FIGS. 3, 4 illustrate how a module with a car is delivered, shutters are opened and a driver gets in his car.
Figure 4:
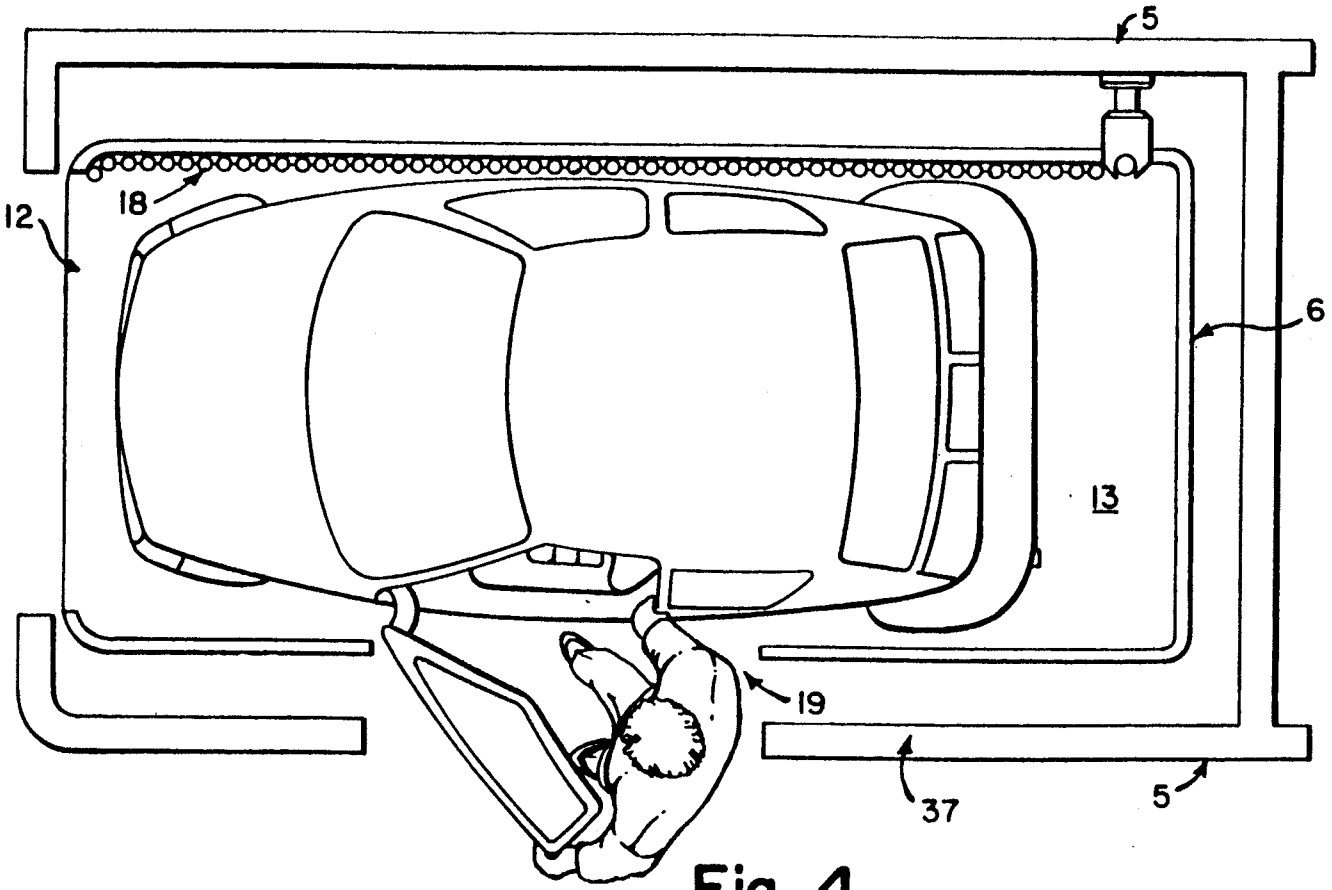
Figure 10:
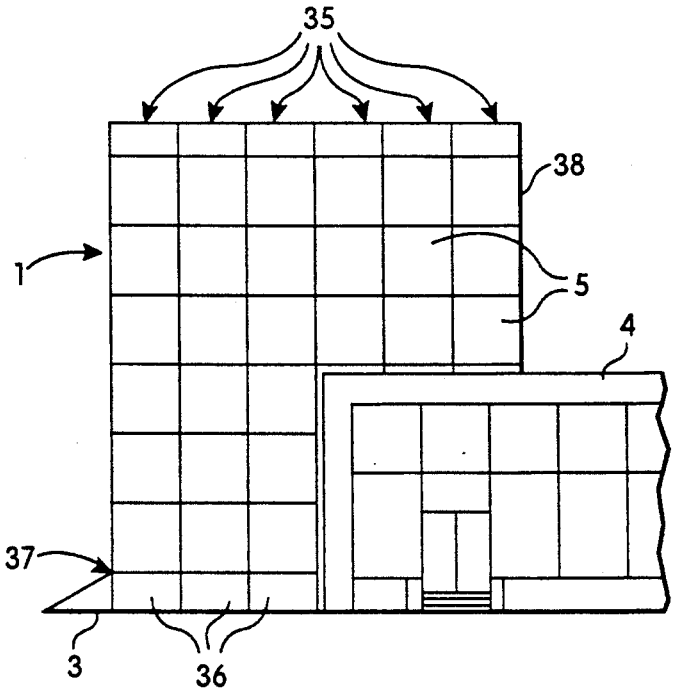
FIGS. 9, 10 illustrate respectively, the side and front views of an L-shaped depot (garage) of modular design located in proximity to a supermarket or airport building.

Building 1 (FIGS. 1, 2, 9, 10 and 11) of the multistorey garage consists of sections 2 (FIGS. 2 and 9) with approach platforms 3 (FIGS. 1, 2 and 10). The building 1 may have a complex configuration (FIG. 10), bending around, say, a supermarket building 4. The sections 2 comprise cells t (FIGS. 2-7, 10 and 11) containing modules 6 (FIGS. 2-8, 12 and 15-17), vertical guides 7 (FIGS. 5-8, 12 and 17), horizontal guides 8 (FIGS. 5-7 and 17), horizontal drive 9 (FIGS. 5-6 and 17) and vertical drive 10 (FIGS. 5-8 and 12). The cells 5 are provided with pairs of door openings 11 (upper and lower) (FIGS. 2, 7 and 12) and 12 (longitudinal) (FIGS. 2, 5-6 and 12).

Figure 15:
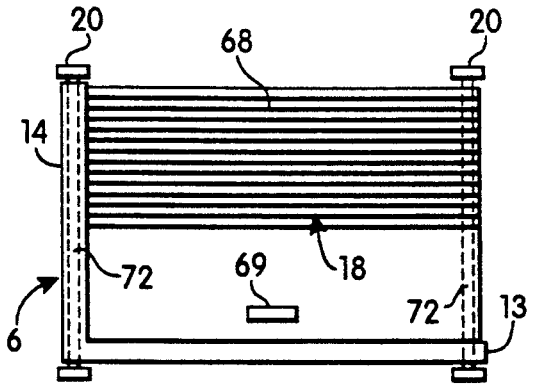

The module 6 comprises platform 13 (FIGS. 3-8 and 15-17), side post 14 (FIG. 14), rollers 15, 16 (FIGS. 5-8, 12 and 17), as well as hoods 17 (FIG. 16), end (18) (FIGS. 2-4) and side (19) (FIGS. 15-16) sliding doors. The module 6 may also incorporate coordinate pushers 20 (FIGS. 15-16).

Figure 5:
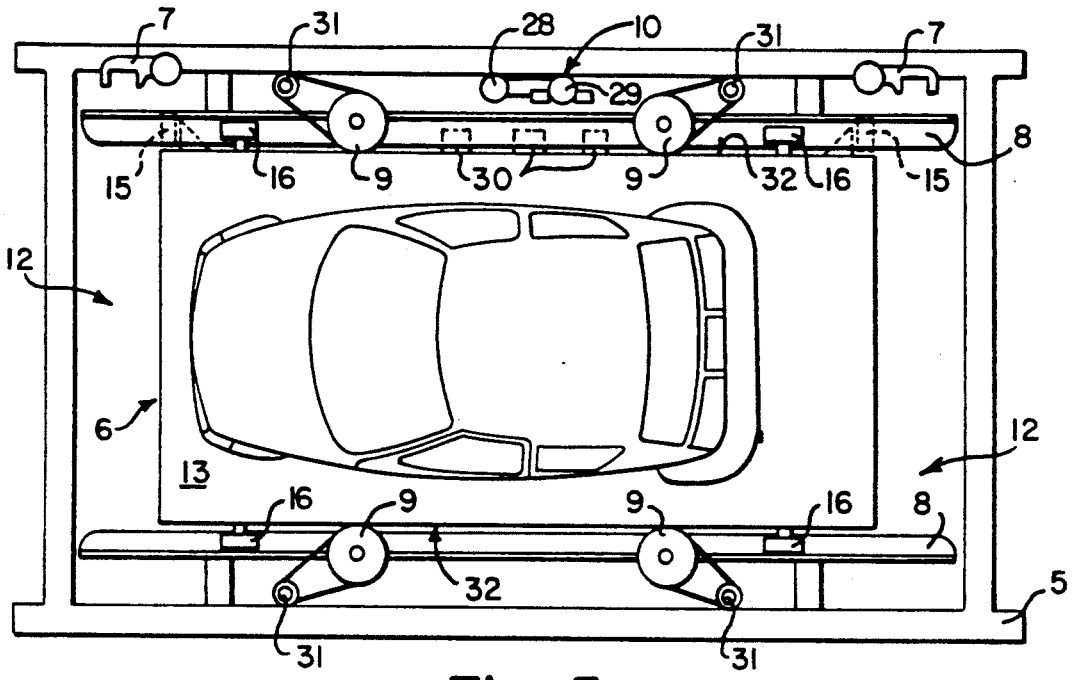
FIGS. 5, 6 illustrate the arrangement of a car in a cell or module, relative arrangement of the guides and drive elements.
Figure 6:
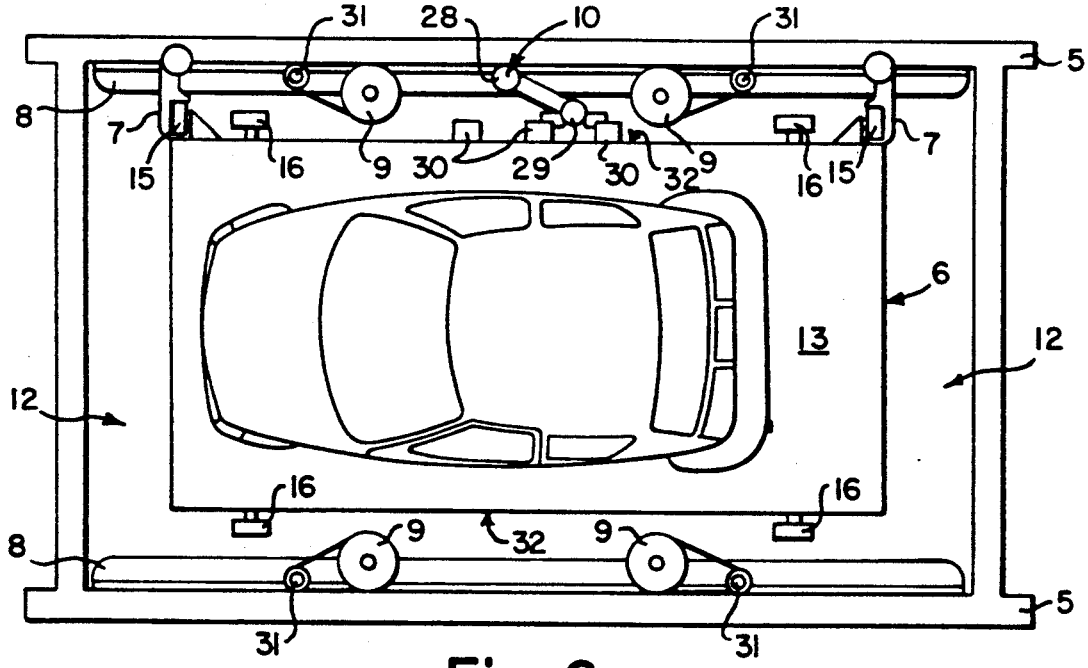
Figure 7:
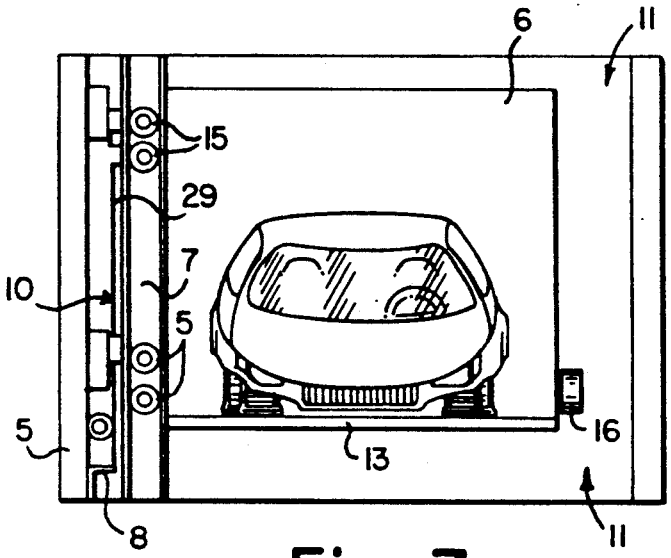
FIGS. 7 and 8 illustrate schematically the process of vertical movement of a module with a car.
Figure 8:
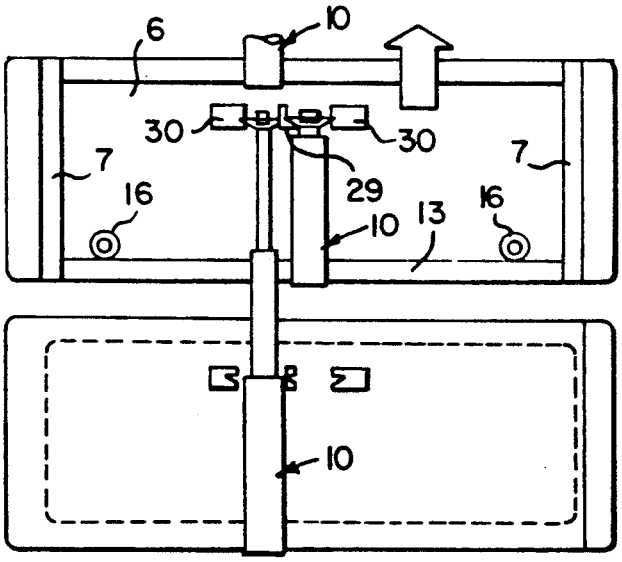

The guides 8 are made in conjunction with, and moved into and out of position by, the drive 21 and the guides 7, in conjunction with, and moved into and out of position by, the drive 22. The guides 7 and 8 are fitted with position sensors 23 and 24, while the cells 5 are equipped with sensors 25, 26 of the horizontal and vertical position of the module, respectively, and horizontal brake 27 (sensors not shown, see control diagram at FIG. 19 and see, generally, FIG. 17). A drive 10 is essentially a telescoping hydraulic cylinder with a drive 28 (FIGS. 5-6 and 17). Fitted to the end of the drive 10 is a controllable support 29 (FIGS. 5-8, 12 and 17), with supporting strips 30 (FIGS. 5-6, 8, 12 and 17) fitted to the module 6. Reversible friction motors (drives) 9 incorporate drive 31 and the side walls of the module 6 are provided with friction coating 32 (see FIGS. 5-6 and 17) which the drives 9 engage and force to move by means of rotation (arrows 9*a*). The modules 6 are also each provided with a unique code marker 33 (FIG. 16) of the module. An identifier 34 (not shown, see control diagram at FIG. 19) is provided in the cell 5.

Figure 9:
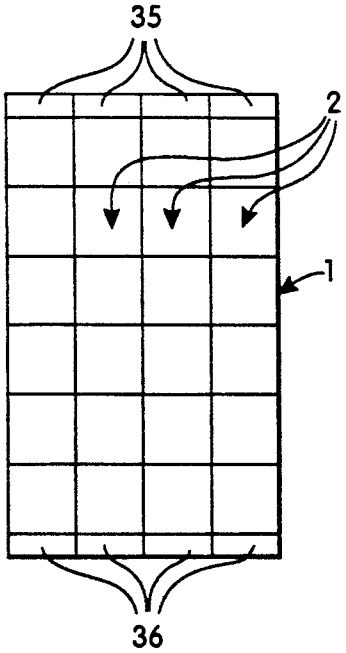
Figure 11:
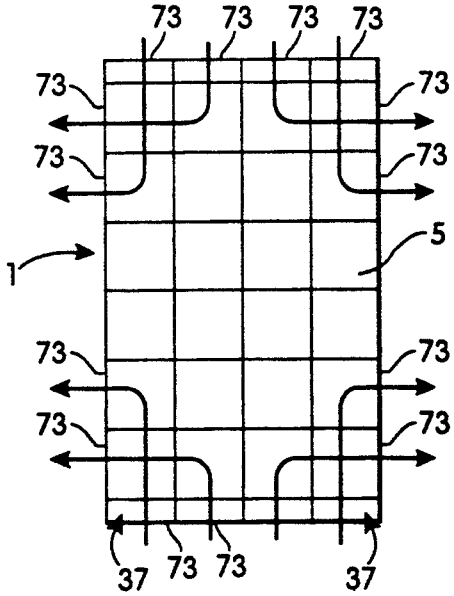
FIG. 11 illustrates a proposed car departure route.
Figure 12:
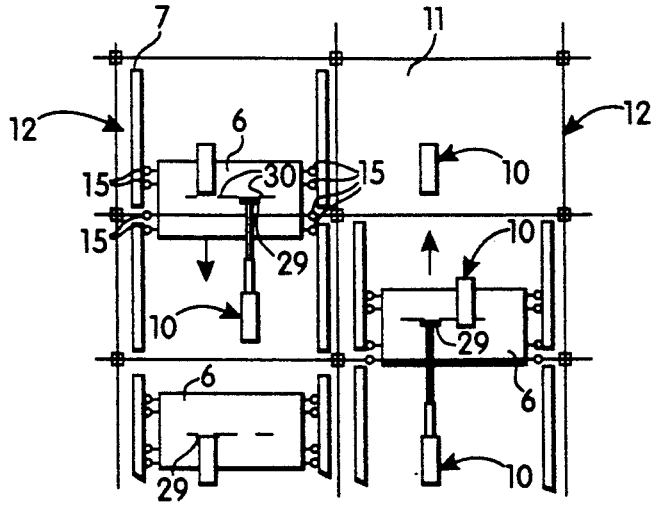
FIG. 12 illustrates the principle of parallel vertical movement of modules in adjacent cells.
Figure 13:
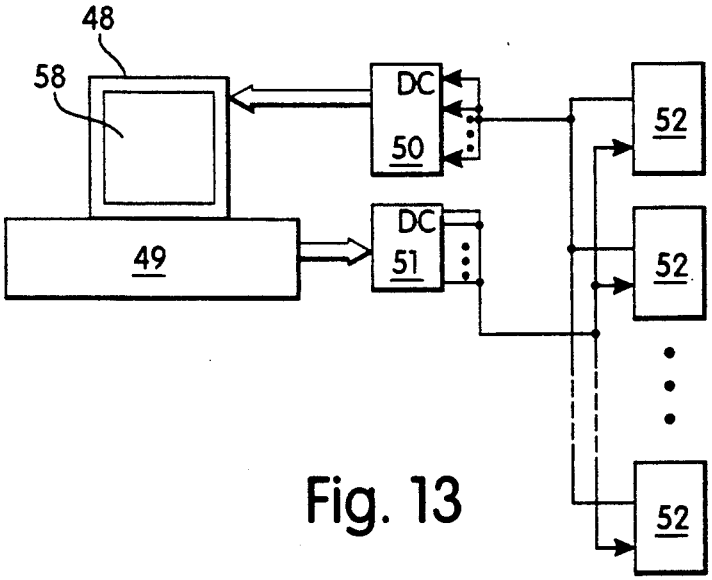
FIG. 13, 14 illustrate the circuit design of an electronic depot (garage) management system.
Figure 14:
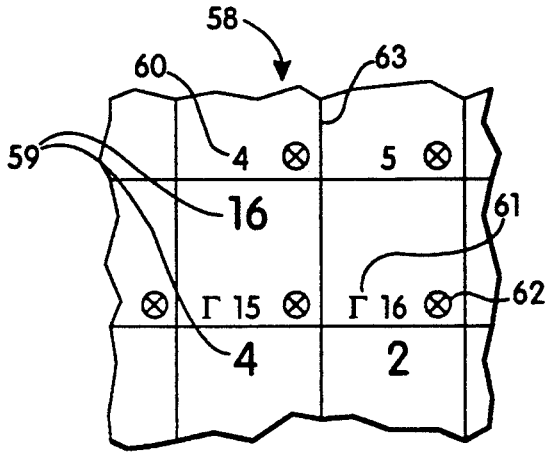

The building 1 is provided with roof modules 35, foundation modules 36, access modules 37, while the external cells may be provided with side panels 38 (see FIGS. 9, 10 and 11).

Figure 16:
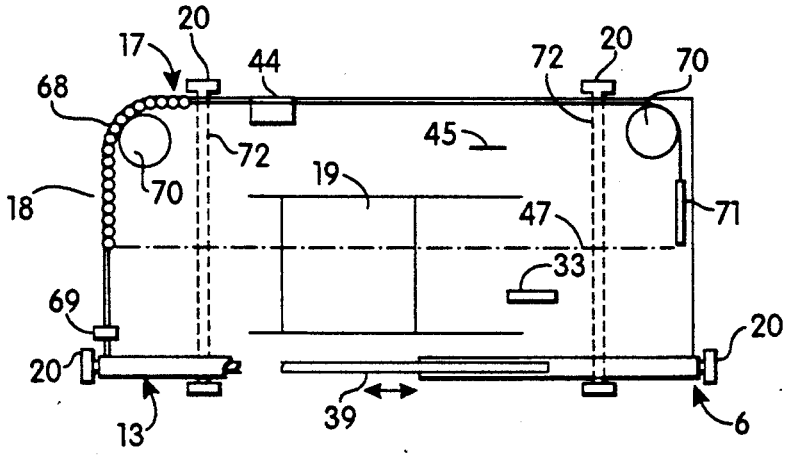
Figure 18:
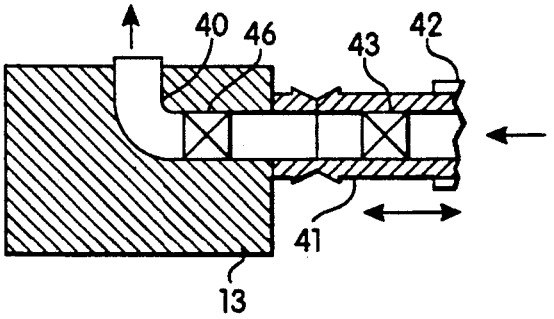
FIG. 18 shows the elements of the fire-fighting system.
Figure 17:
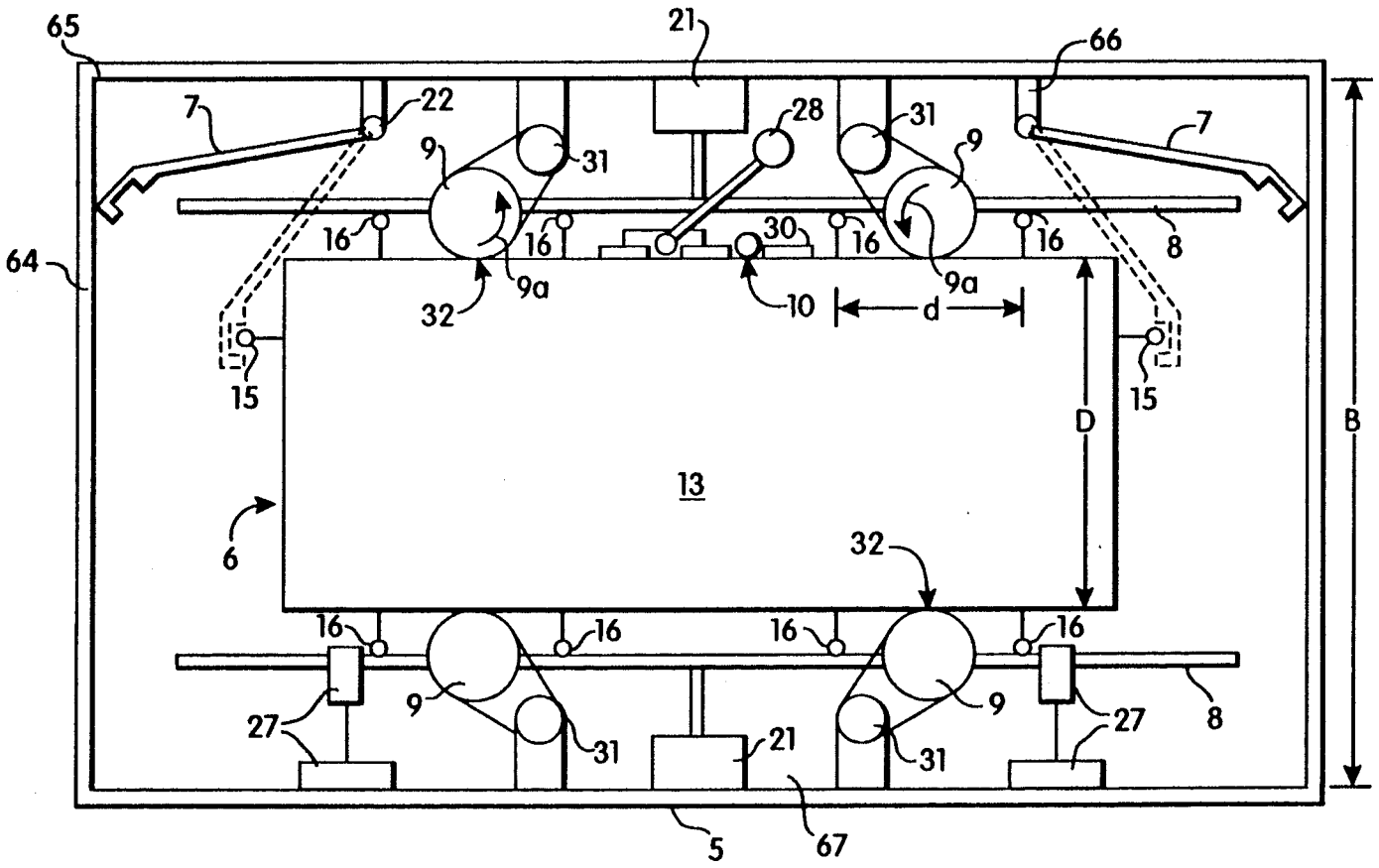
FIG. 17 shows its arrangement in the cell along with the drive elements and the guides.

Platform 13 may feature a sliding hatch 39 (FIG. 16). The module 6 may incorporate, through the platform 13, as shown in FIG. 18, a ventilation pipe 40 connected to the exhaust pipe 41 of the ventilation and heating system, which is fitted with a drive 42 and a shut-off device 43. A smoke sensor 44 and a fire-fighting system 45, shown in FIG. 16, are housed in the module 6, with valve 46 fitted in pipe 40.

The repair module 6 contains guard 47 (shown in phantom in FIG. 16) instead of the hood 17. The control module 6 contains display 48, control console 49, input (50) and output (51) decoders connected to control units 52 for the modules 6, which turn on the decoder 53, an OR gate 54 and timer 55. The cells 5 also contain sensor 56 of the position of hydraulic cylinder 10 and sensor 57 of the position of the motors 9 (see control diagrams in FIGS. 13 and 19).

Screen 58 of the display 48 has provisions for module code marker fields 59 (see FIG. 14), cell number fields 60, probable direction of movement fields 61 and fields 62 for indication of faults in the electrical equipment of the cell. The fields 59 through 62 may be divided by lines 63.

As shown in FIG. 17, frames 64 of the cells 5 are jointed by fasteners 65. The drives 22 are mounted on brackets 66, with drives 31 mounted on brackets 67. As shown in FIGS. 15 and 16, door 18 may be made in the form of shutters 68 which can be slid along guides 70 by means of handle 69. The shutters 68 are balanced by counterweight 71 and the pushers 20 are connected to the posts 72.

On the ground floor of the building 1, there may be provided exits 73 (FIGS. 1 and 11) which can be simultaneously used for admission of a car 97 and departure of cars 98, 99 (FIG. 1). The cells 2 may be mounted on rods 100 (FIG. 2).

The garage serves its intended function as follows. Incoming cars drive over the access modules 37 to the modules 36 and on to the respective working modules 6 of the given section 2. The door 18 is opened by the passenger by means of the handle 69 and closed from the inside by changing the position of the counterweight 71 by means of the respective drive. The passenger leaves the building 1 through the door 19 and the exit 73. Further movement of the module 6 is accomplished automatically, so that during horizontal movement of the module 6 along the guides 8 the guides 7 and hydraulic cylinders 10 are moved aside and during upward or downward movement of the module along the guides 7 moved aside, i.e. toward the side walls of the cells 5, are the guides 8 and the motors 9.

During the upward or downward movement the rollers 15 toll over the guides 7. The supports 29 interact with two strips 30, while the hydraulic cylinders 10 which are not involved in the displacement of the module 6 pass between the strips 30. As shown in FIG. 6, the telescoping hydraulic cylinder 10 of the lower floor lifts the module 6 to a height necessary to mount the module 6 on the support 29 of the hydraulic cylinder 10 of the upper floor. The guides 7, 8 of the cells 5 are not joined together and the continuity of motion of the module 6 is ensured by the presence of the pairs of rollers 15, 16. Vertical displacement of the modules 6 is effected through openings 11 and horizontal displacement, through openings 12.

In this way, each cell 5 of the section 2 is provided with a two-coordinate drive for displacement of the module 6. All modules 6 of the given section 2 may be set in motion simultaneously. The movement of the modules 6 is effected and monitored by means of console 49 and the display 48. The operator or the control computer have the capability to designate in the section 2 the short-term and long-term storage areas and priority service areas. The streamline the control process, the decoder 53 provides for simultaneous actuation of a number of items of electrical equipment of the cell 5.

Consider in more detail the algorithm for controlling the movement of the module 6. To change over from the horizontal to vertical movement, proceed as follows:

install the hydraulic cylinder 10 and remove the motor 9 in the admission and recovery cells 5;

install the vertical guides 7 in both cells and activate support 29 in the recovery cell 5;

raise the module 6 by means of the hydraulic cylinder 10 of the recover cell 5;

remove the brake 27 in both cells 5;

remove the brake 27 in both cells 5;

remove the guides 8 in both cells 5.

The algorithm for changing over from the vertical to horizontal movement is as follows:

install the guides 8 in both cells 5 and the brake 27, in the recover cell;

lower the module 6 by means of the hydraulic cylinder 10 of the recovery cell 5;

remove the support 29, hydraulic cylinder 10 and guide 7 in both cells 5;

install the motor 9 in both cells 5 and remove the brake 27 in the recovery cell 5. The brake 27 is also removed when the horizontal movement of the module 6 is to be resumed.

The operations described above are preparatory. Movement of the modules 6 is accomplished as follows: when the module 6 is delivered from the lower cell A to the upper cell B, the decoder 53 of the cell A is fed with the "deliver", "up" signals and the decoder 53 of the cell B is fed with the "accept" and "up" signals, in which case the items of electrical equipment in the cells 5 are controlled in accordance with the following program;

transfer from horizontal to vertical movement (if horizontal movement was employed) in both cells;

activation of the hydraulic cylinder 10 in cell A;

lowering of the hydraulic cylinder 10 and disengagement of the support 29 following operation of the sensor 26 in the cell A, activation of the support 29 and lifting of the hydraulic cylinder 10 following operation of the sensor 26 in the cell B, i.e. before lowering of the hydraulic cylinder 10 in the cell A.

The module 6 is delivered from the upper cell B to the lower cell A in response to the "deliver", "back" and "accept", "back" signals, respectively, in the following order:

transfer from horizontal to vertical movement (if horizontal movement was employed) in both cells;

activation of the support 29, lifting of the hydraulic cylinder 10 in the cell A;

removal of the support 29 in the cell B;

lowering of the hydraulic cylinder 10 in the cell A.

Forward movement from the cell A to the cell B is accomplished in response to the "deliver", "forward" and "accept", "forward" signals in the following sequence:

transfer from vertical to horizontal movement (if vertical movement was employed) or removal of the brake 27 (if the opposite is true) in both cells;

activation of the motors 9 in both cells;

deactivation of the motor 9 in the cell A at the instant of operation of the sensor 25, deactivation of the motor 9 and engagement of the brake 27 in the cell B in response to a signal from the sensor 25.

And, finally, backward movement from the cell B to the cell A is accomplished in response to the "deliver", "back", and "accept", "back" signals in the following sequence:

transfer from vertical to horizontal movement or removal of the brakes 27 in both cells;

activation of the motors 9 for backward operation in both cells;

deactivation of the motors 9 in both cells and engagement of the brake 27 in the cell A in response to signals from the respective sensors 25.

Naturally, the algorithm in question may be modified depending on the design of the electrical equipment of cells 5. The information concerning the current position of the guides 7, 8 is presented on the display screen 58 (FIG. 14), enabling the operator to forward the module 6 with the code marker 26 from the cell "15" to the cell "16" or to the upper cell "4". Since every cell 5 incorporates drive elements, the operator may shift some of the modules 6 to clear the passage for other modules 6, and to move the modules 6 beforehand from the long-term storage area close to the module 37 to meet the deadline set by a passenger.

If a successive operation of the algorithm described hereinbefore is not performed within a predetermined period of time, unit 52 will operate via the decoder 50 to display on the screen 58 the trouble that occurred in the corresponding cell. In this case, the operator (the function of the operator may be performed by the successive passenger) may forward the module from a particular cell in another direction and, if this fails to correct the trouble, jammed module 6 can be pushed out of the given cell by using the pushers 20 of adjacent modules 6. For repair of the equipment of the cells 5 or the cars located in the modules 6, provision is made for the repair modules 6 delivered to a respective cell in the manner described above or by applying priority control signals to a control line formed by the buses connecting the units 52 to the decoders 50 and 51. Acess to a car can be gained through the hatch 39.

When the module 6 has occupied a fixed position in the cell 5, the drive 42 operates in response to a signal furnished from the console 49 or decoder 53 to fit the pipe 41 on the pipe 40 and open the shut-off device (the valve 43), following which warmed-up dry air starts coming under the hood 17. If fire breaks out in the cell 6, the sensor 44 activates the fire-fighting system 45 which fills the space of the cell 6 with foam. At the same time (in response to a signal furnished by the sensor 44), the valve 46 is shut off and a fire alarm is activated, say, on the display 48.

Figure 19:
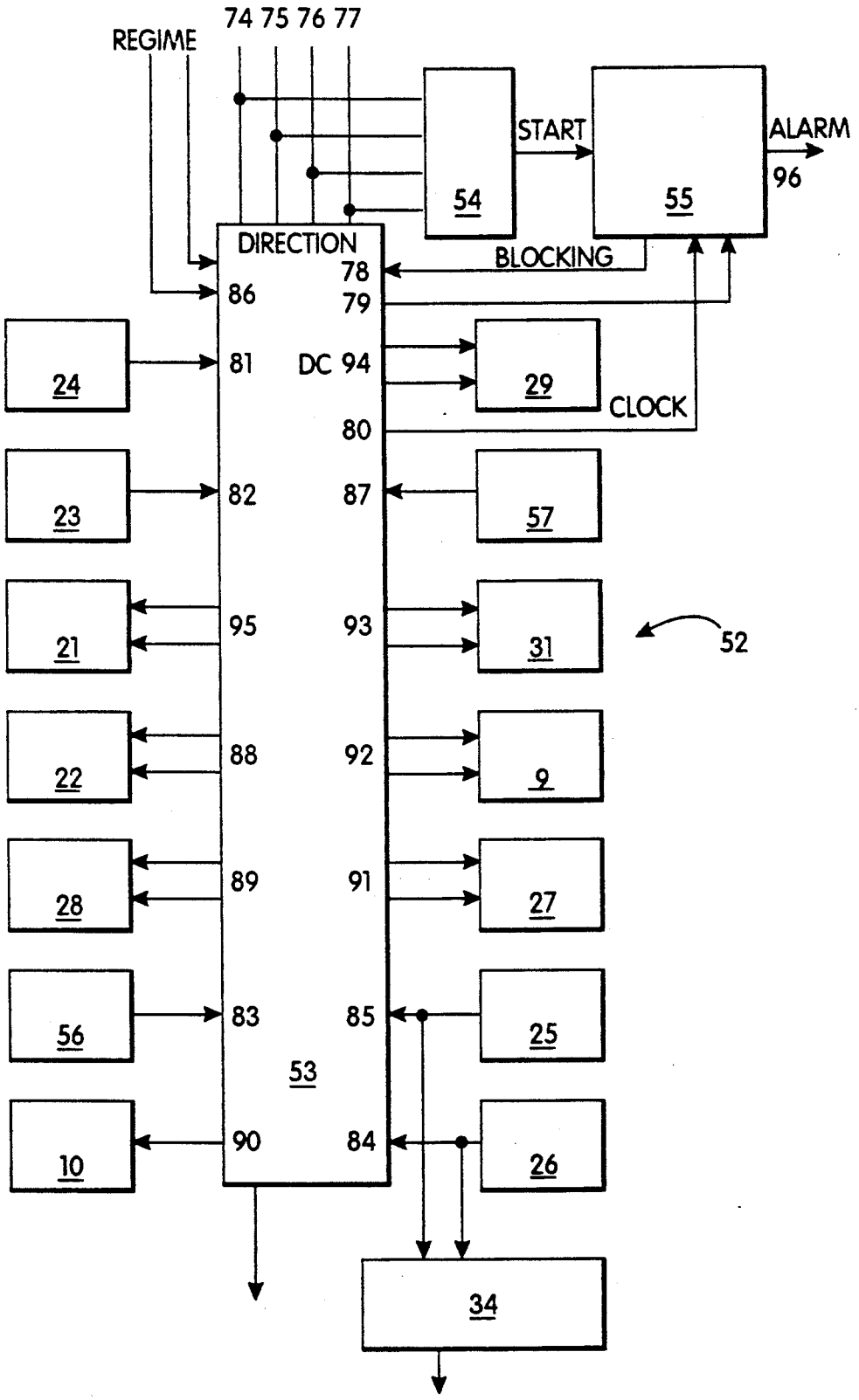
FIG. 19 is a functional diagram of the electrical and electronic equipment of a cell.

As has been previously mentioned, the console 49 (FIG. 13) may incorporate a microprocessor to effect control over the movement of the modules 6 and optimize the travelling paths thereof. In addition to retransmitting, multiplexing and demultiplexing, the decoders 50, 51 may perform other interfacing functions, such as data buffering, serial-to-parallel code conversion, level matching, signal storage. The decoder 53 and the timer 55 can also be employed in conjunction with controllers operating on the basis of the algorithm described above. Besides, these devices may be synthesized in terms of the input and output sequence also determined by the aforementioned algorithm. For instance, upon arrival of the "forward" and "deliver" signals at inputs 74–77 of the decoder 53 (assuming that the status of the sensors 24, 23, 56, 57 corresponds to the vertical movement and the sensors 25, 26 indicate that the module 6 is present in the particular cell 5), the decoder 53 activates the drive 21 and deactivates it upon operation of the sensor 24, activates the hydraulic cylinder 10 for a period of time sufficient for lowering the module 6 on the guides 8, then deactivates the support 29, activates the drive 28 to remove the hydraulic cylinder 10, activates the drive 22 to remove the guides 7 and deactivates the drives following operation of the sensors 56, 23 or after a predetermined period of time, then activates the drive 31 to bring the motors 9 to the operating position and deactivates the drive 31 upon operation of the sensor 57. This completes the process of transferring from the vertical to horizontal movement. The next operation is to activate the motors 9 for forward operation and deactivate the motors following operation of the sensor 25. The operations listed above are accompanied by the exchange of information at the respective inputs 81–87 and outputs 88–95 of the decoder 53 (FIG. 19).

The position sensors (i.e. the sensors 24, 23, 56, 57, 25 and 26) may be made as a set of contact pickups (limit switches), whose output signals determine unambiguously the spatial position of the object being monitored in the vicinity of a particular module. Accordingly, FIG. 19 shows only the functional arrangement of the unit 52, with connections made through control or data buses. The identifier 34 may be made in the form of a hard magnetic strip magnetized in a predetermined manner and fitted to the module 6, and a magnetic sensing element with an output register provided in the cell 6. Information is read into the register in response to a signal from the respective sensors (or one of the sensors 25, 26. The identifier 34 may also be of the optical type (in the form of a mask, radiator and photodetector).

After the timer 55 is started by the output signal of the element 54, the timer 55 blocks the decoder 53 at input 78 for the period of delivery or acceptance of the module 6, with the result that the decoder 53 cannot accept a new signal at direction inputs 74–77 during this period of time. After the next operation is performed, the decoder 53 resets the timer 55 over output 79 (for instance, initial resetting will be made after successive activation and deactivation of the drive 21 in the example considered above). Immediately after resetting, a trigger pulse for the timer 55 is developed at clock output 80 of the decoder 53. As a result, if the subsequent operation is not performed, no reset pulse will be fed to the timer 55 which will generate an alarm signal 96 which will be sent via the decoder 50 to be displayed on the field 62 of the screen 58. The timer 55 may be made in the form of a clock pulse generator whose output is coupled to the synchronizing input of the decoder with a memory, whose other inputs are fed with the trigger and reset pulses.

From the above-said, it follows that the introduction of the coordinate guides 7, 8 and the coordinate drives 9, 10 as part of each cell 5 makes it possible to effect continuous and simultaneous movement of all modules 6 along random, including optimal trajectories. The modules 6 may have a knock-down construction to facilitate dismounting to increase the speed of operation and throughput of the garage. This makes it possible to minimize the number of passages and expand the cells 5 in the sections 2. Owing to the replacement of the passive platform by the module 6 interacting with the guides 7, 8 and the drive elements and the provision of the openings 11, 12, a car can be moved from one area of the garage to another without crossing the path of other cars being moved. Under this arrangement, one or more cells 5 are free of the modules 6, allowing the latter to be interchanged. Provisions are made both for the stacking order of filling the section 2 and a programmed order, whereby a module with a car is delivered to the egress cell to meet a deadline. The final operation of delivery may be accomplished by keying a private code on a console, using a magnetic identification card, etc.

The replacement of the open platform by an enclosed module has made it possible to move the car along the coordinates (see above) and provide local air-conditioning and fire-fighting facilities. The fire hazard is greatly reduced without resorting to specialized facilities since the hood 17 prevents influx of air to the source of fire. Moreover, the elements of the module 6 (the pushers 20) are used for emergency delivery of the car to the user, effectively preventing any delay sin the delivery of the car. Thus, the module 6 is a multifunction element providing for movement and safety of a car.

The hydraulic cylinders 10 serve not only for vertical movement of the modules 6, but also provide the means for locking thereof, damping any oscillations that might arise and guarding against falling.

The modular design of the building 1 permits it to be erected in built-up and congested areas. Optically transparent panels make it possible to observe the condition of a car and keep under control a fire or emergency situation. Small gaps between the walls of the cells 5 and the modules 6 prevent vandalism and larceny. At the same time, despite dense packing of cars in the sections 2, the repair modules 6 provide easy access to the cells 5. The pumping modules 6 are fixed on the respective floors (e.g. on the ground and twelfth floor of a 24-storey section) to main pressure in the hydraulic drive system. The repair modules 6 can also be used for storage of cars.

The garage can also be used as an automated depot without any changes in construction.

Now, consider an embodiment of the depot (garage) illustrated in FIGS. 20 through 30.

Figure 20:
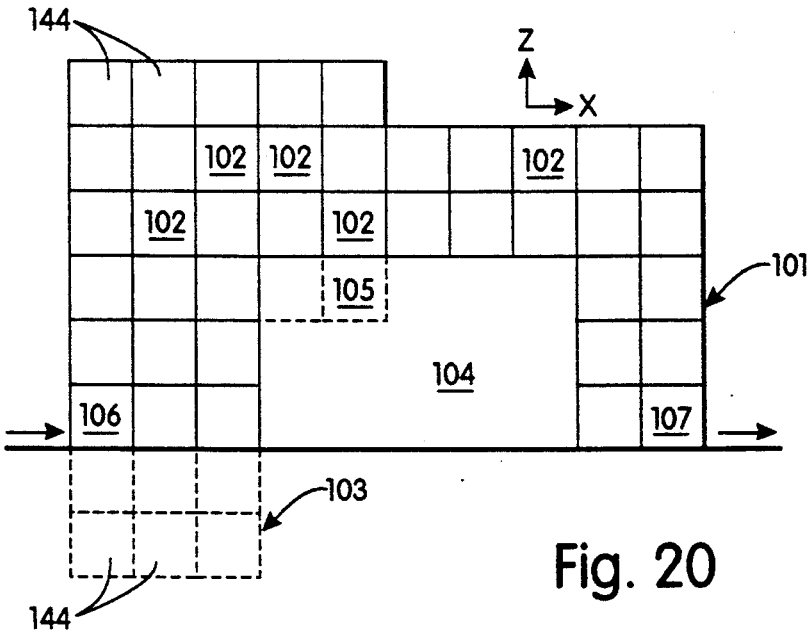
FIG. 20 illustrates a depot (garage) of a more complex configuration, partially integrated into a supermarket or airport building.

A palletized cargo depot comprises a building 101 consisting of cells 102 (FIG. 20). The configuration of the building 101 may be arbitrary, it can be assembled from standard cells 102 and contain a basement 103, bend around a building 104 and incorporate built-in cells 105. Any one of the cells 102 can be used in the ingress (cell 106 in FIG. 20) or egress (cell 107) function. There may be provided a number of the cells 106, 107.

Figure 25A:
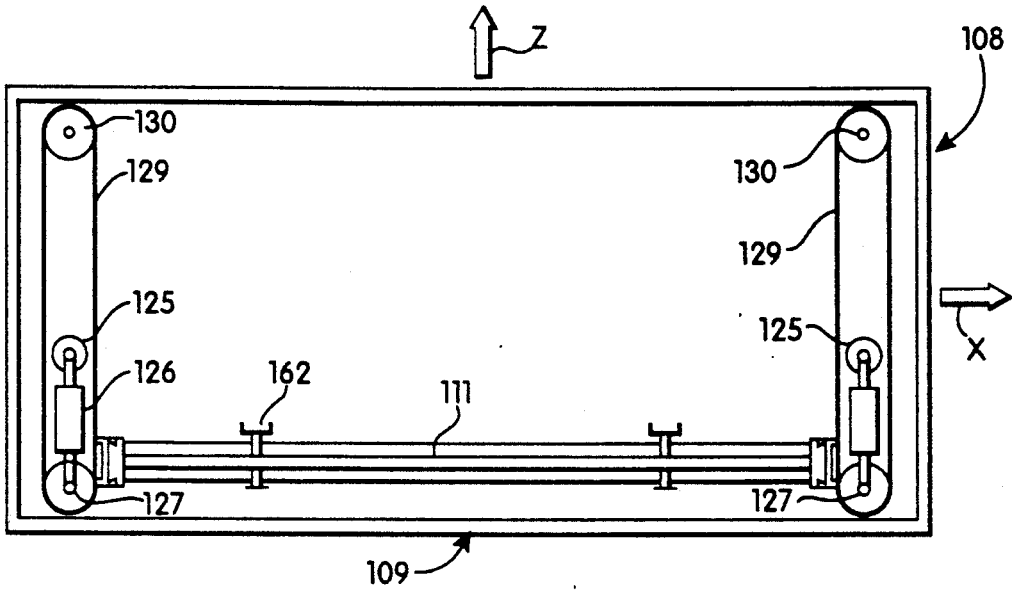
Figure 25B:
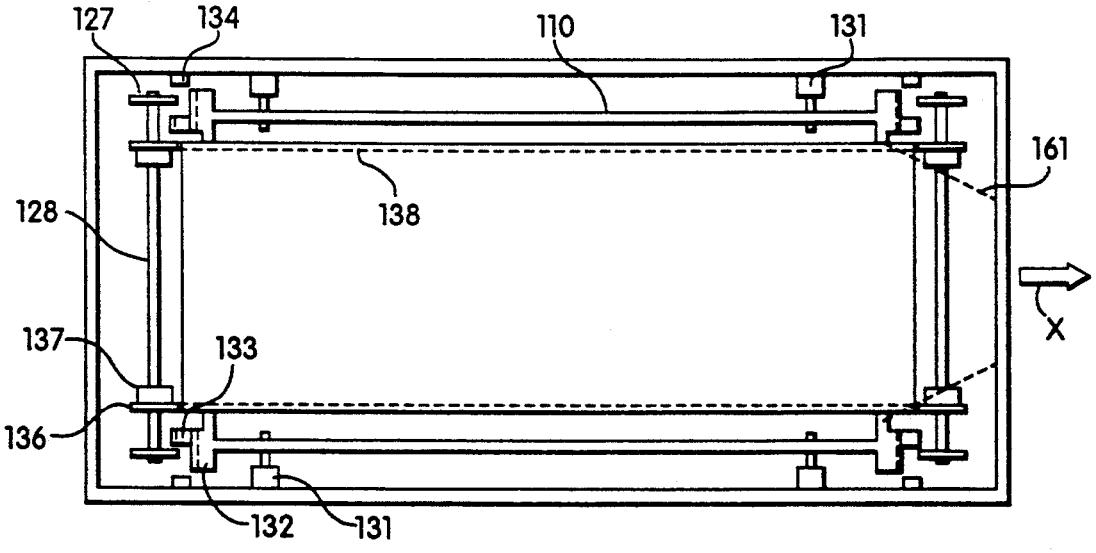
Figure 26:
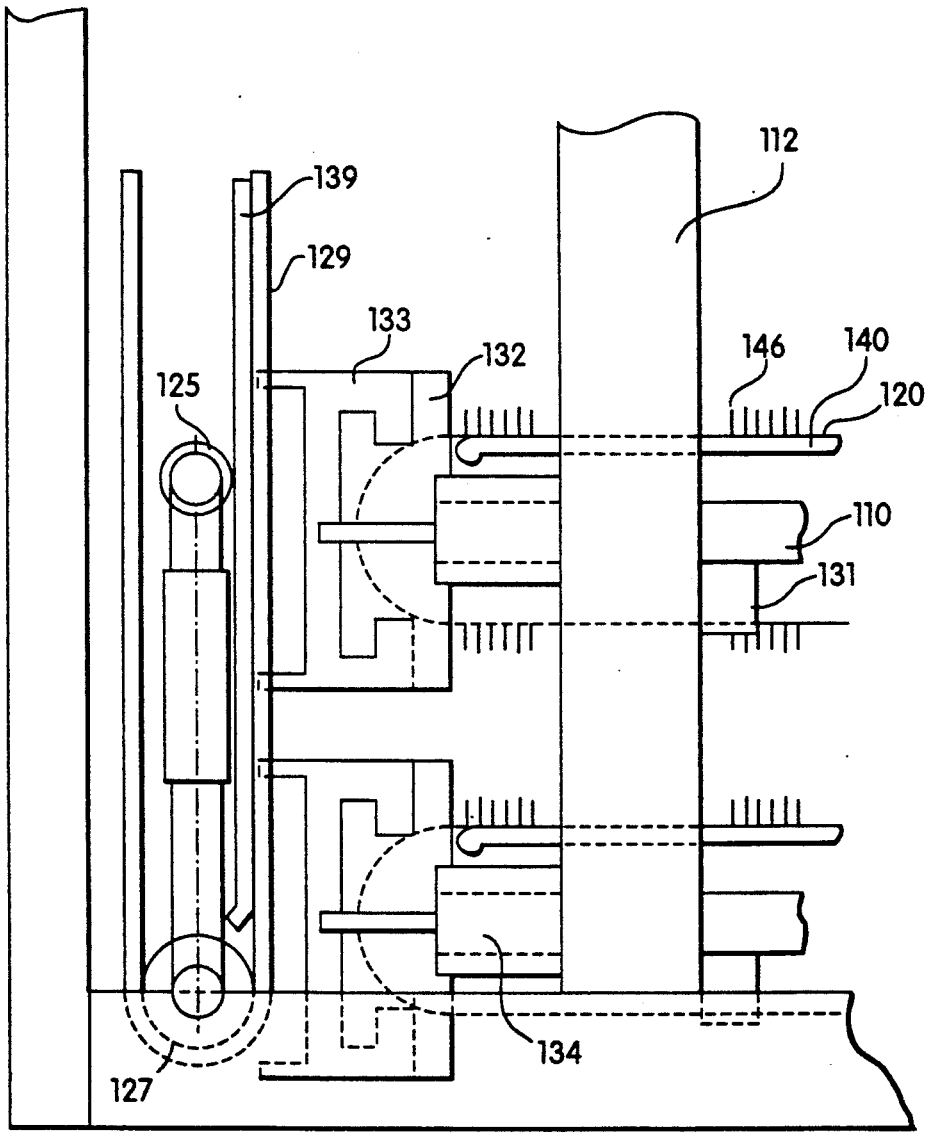
Figure 27:
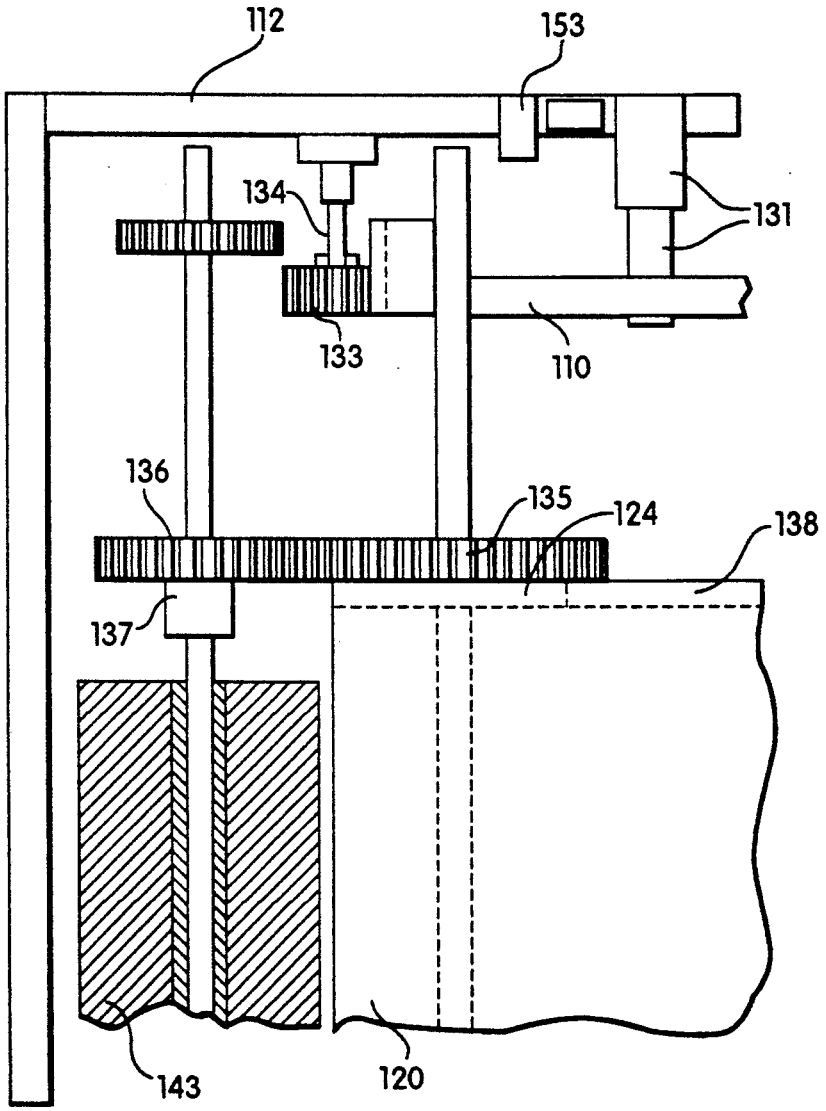
Figure 28:
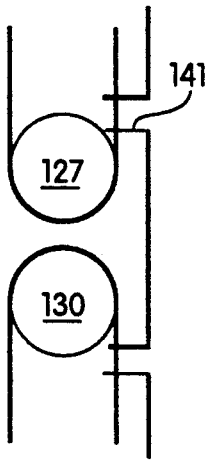

The cell 102 is essentially a parallelepiped (of metal construction) with coordinate-oriented openings, e.g. openings 108 along the X axis and 109 along the Z axis (FIGS. 20 and 25). In relation to the Y axis, the cells 102 may be blind, as may be the walls of the building 101. Each cell 102 contains a coordinate drive (operating along the X,Z axes in the case under consideration). The drive is made in the form of a frame 110 and a conveyor 111 (FIGS. 25, 26, 27).

Blind walls 112 of the cells 102 (FIG. 24) mount hydraulic cylinders 113 (a telescopic hydraulic drive) in a staggered arrangement. Turning thereof is effected by a drive 114 and a bracket 115. The ends (bearing pads) 116 of the hydraulic cylinders 113 interact with rests 117 of the frame 110 which features corner rollers 118 located in the guides 119. The conveyor 111 comprises a belt 120 driven by a motor 121 mounted on one of shafts 122, 123. The shafts 122, 123 fit gears (angular sprockets) 124.

In the cell 102 shown in FIGS. 25–29, the cargo handling mechanism includes reversible synchronous motors 125 coupled via a reduction gear 126 to end gears 127 symmetrically disposed about drive shafts 128.

The gears 127 carry chain drives 129 with gears 130 and the cells contain retractable rests 131 against which can bear the frame 110, with guides 132 disposed at the corners thereof and accommodating a carriage 133 drive by a controllable carrier 134. The latter may be made in the form of a turning lever or telescopic hydraulic drive (hydraulic cylinder) with an electromagnet fitted to its end. The carrier 134 serves for moving the carriage 133 along the guide 132 (for instance, of the dovetail type). The guides 132, carriage 133 and carrier 134 make up a controllable grip.

The sprockets are linked by means of, say, gears 135 to intermediate gears 136 fitted on the left-hand shaft 128 with controllable (magnetic) clutches 137. The belt 120 of the conveyor 111 may be formed by the common axles of the chain drives 138 provided on the sprockets 124. The drives 138 (belt 120) and the drives 129 are fitted with thrust skids 139, 140 made of fluoroplastic impregnated with graphite. The skid 139 is secured to the cell 103, with the skid 140 secured to the frame 110.

Figure 22:
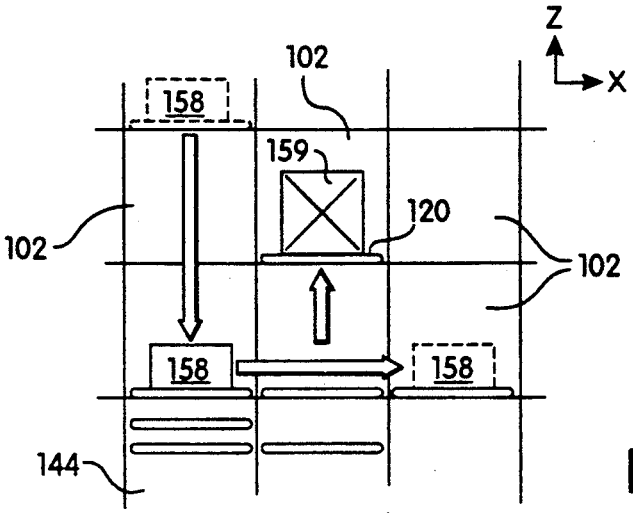
Figure 23:
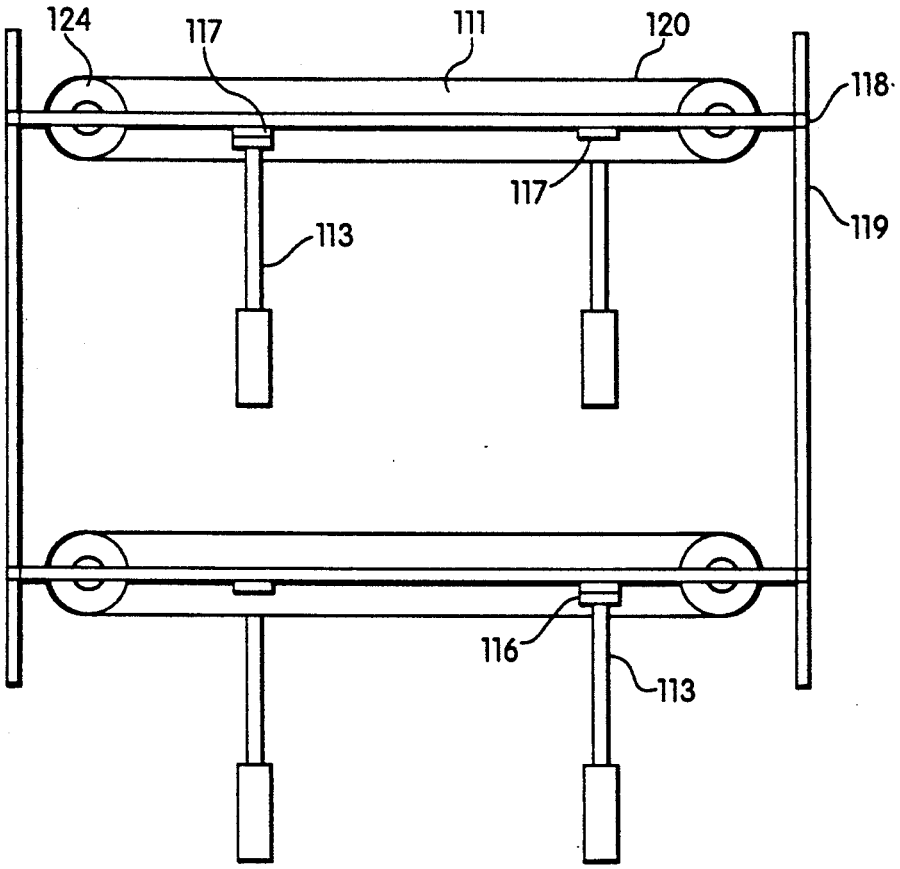
FIGS. 23, 24 and 25A and B through 29, respectively, illustrate two different embodiments of a cargo handling mechanism.
Figure 24:
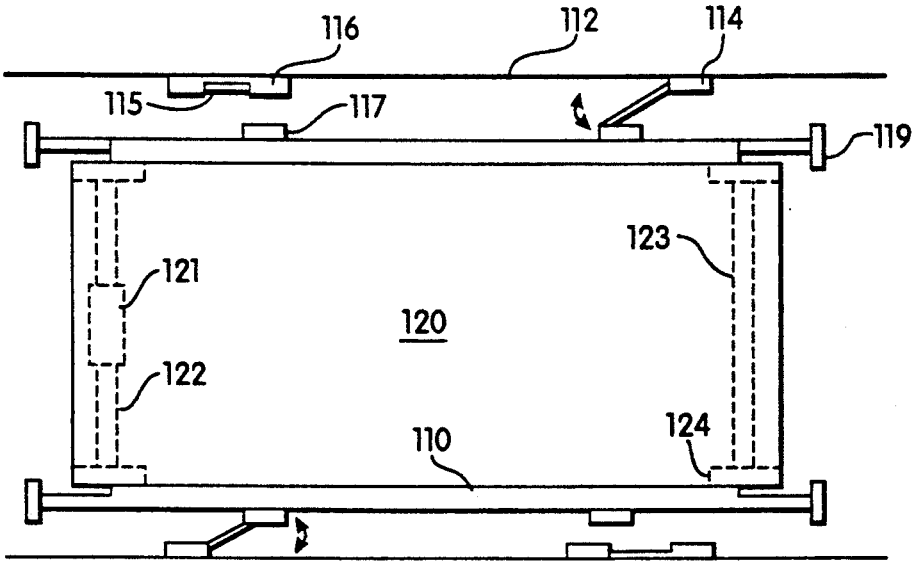

On the side of the drive 130, the carriage 133 has two pins 141 and the drive 130, projections 142. The shafts 129 may be provided with damping rollers (rubber cylinders) 143 (FIG. 22).

The cells 144 (FIGS. 22, 26) perform the accumulating function in the vertical shaft. These cells contain several, e.g. 5 rests 131 and carriers 134. Cargoes 145 are arranged on the conveyors 111, with conveyor belt 120 featuring elastic projections 146 (FIG. 26) of the artificial grass type, rubber flanges or other friction coating of cells in the garage may be of accumulation type, so one may use rests 131 situated on one level in adjacent vertical shafts for horizontal movement of the cargo.

Figure 21:
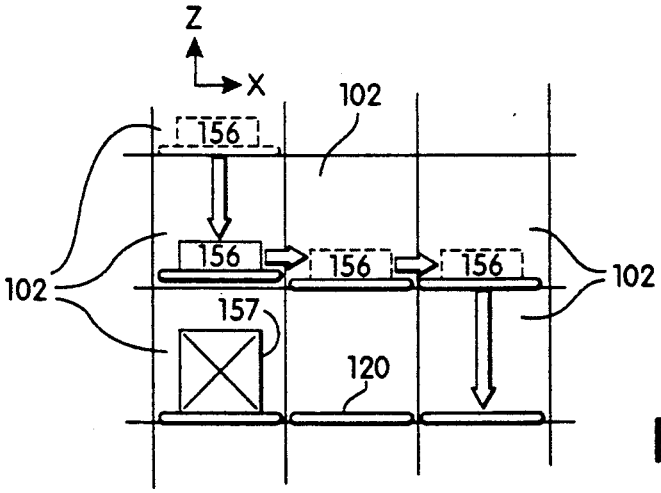
FIGS. 21, 22 illustrate movement of cargoes arranged on a platform rather than in a module.
Figure 29:
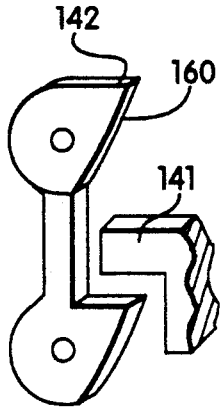
Figure 30:
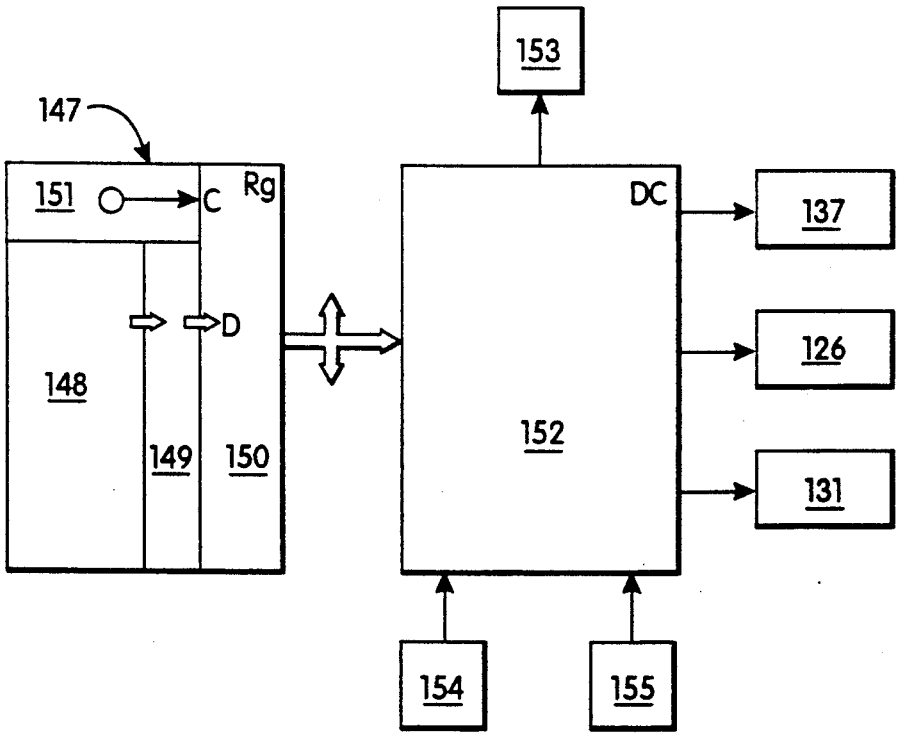
FIG. 30 illustrates possible realization of the electrical equipment of the cell in this case.

A control console 147 incorporating, for instance, a keyboard 148, decoder 149, register 150 and button 151 is connected to the decoders 152 of the cells 102 whose output signals are coupled to the drives 153 of the carriers 134 effecting input control of the clutches 137, motors 126 and rests 131. The cells 102 are provided with frame position sensors 154 and cargo position sensors 155 (photosensors, contact sensors, etc.). FIGS. 21, 22 show cargoes 156, 157, 158 and 159. FIG. 29 shows a chamfer 160, with FIG. 25 showing angle guides 161 and vertical damping supports 162. The size of the supports 162 is selected to ensure engagement of the projections 146 of the conveyors that come in contact with the supports 162.

The depot runs along the following liens. The cargoes are arranged in the cells 102 on the belts 120 in random order. The depot incorporates provisions for simultaneous movement of cargoes and changing the position thereof in any section (FIGS. 21, 22). If the depot does not contain accumulating cells 144, vertical movement is accomplished in a step-by-step manner (FIG. 21) or by several steps at a time if the accumulating cells are available (FIG. 22). FIGS. 21, 22 illustrate a depot with a two-coordinate drive. According to this arrangement, it will suffice to have one to two unoccupied cells 102 in each section (in vertical cross-section).

Vertical movement of cargoes is accomplished by way of displacement of the frame 110 and horizontal movement, by the movement of the belt 120. instead of a belt of the conveyor one can use a horizontal guide for a wheel of a car and a roller pusher, situated behind the wheel. In the embodiment illustrated in FIGS. 23, 24 the belt 120 (two chain drives linked by axles or a caterpillar drive) is moved by gears 124. The conveyor 111 may be elevated by the telescopic hydraulic cylinders 113 which by turn support the frame 110. When the frame 110 passes the pair of the hydraulic cylinders 113 of a particular cell 102, the cylinders are brought to the operating position by means of the lever 115 to support the frame 110. The horizontal distance between the belts 120 of the adjacent cells 102 is short so that when the reversible motors 121 are simultaneously activated for operation in the same direction the cargo 56 or 58 is smoothly transferred from one cell 102 to another. The cargo may be arranged in a container or set up directly on the conveyor 111 (a car). In this case, the lowered conveyor 111 may be positioned slightly higher than normal (FIG. 21) or on a level with the conveyor 111 of the adjacent cell 102 (FIG. 22). Cargoes come to the ingress cell 106 of a particular section of the cells 102 and are forwarded to the respective portion of the section (FIG. 20) depending on the anticipated storage term. Delivery of cargoes takes place from the cells 107.

In the embodiment illustrated in FIGS. 25A and B through 29, movement of cargoes is effected by a single motor 125. During horizontal movement, the frame 110 rests on the rests 131, the carriage 133 is disengaged from the gear 127 by means of the carrier 134 and the clutch 137 is coupled to the shaft 129. The motors 125 act through the clutches 137 to drive the gears 136 linked by the gears 135 (or directly) to the sprockets 124 which carry the drives 138 of the belt 120. The guides 161 direct the cargo in the opening 108.

To transfer to vertical movement, the drives of the carriers 134 (the cell 102 contains fours carriers) engage the pins 141 of the carriage 133 with the projections 142 of the drives 129. The distance between the pins 141 is such that when the frame 110 is transferred from one cell to another the frame 110 is held by one pin 141. The frame 110 is raised, the rests 131 are removed and the motor 125 acts via the reduction gear 126, gear 127 and drive 129 to effect vertical movement of the conveyor 111. The clutch 137 is disengaged in this case. After vertical movement of the frame 110 has been completed, the rests 131 are extended to provide support to the frame 110. Next, the carriers 134 disengage the carriage 133 from the fixed drive 129 and the clutches 137 are engaged for transfer to horizontal movement.

If the walls 112 of the cells are made transparent, the operator has the capability to control the movement of cargoes directly by means of the console 147 by engaging the clutches 137, moving the carriage 133 and so on. To facilitate the operator's job, a decoder 152 is placed in the cells 102 between the respective outputs of the console 147 and the control inputs of the rests 131, clutches 137, motors 125, etc. Synthesis of the decoder 152 is accomplished on the basis of the specified input and output sequences which, in turn, are determined by the sequence whereby horizontal and vertical movement of cargoes is accomplished as described above. For example, the operator sets up the following combination on the keyboard 148: cells Nos 56, 57—"forward", cell No. 61—"down". The decoder 149 converts this data into a parallel code which is input to the buffer register 150 when the button 151 is depressed. The buffer register can exchange information with the decoders 152 of the cells via a respective interface. In this case, the cells Nos 56, 57 will receive a "forward" code combination and the cells Nos 61, 62, a "down" code combination. The leading edge of these signals causes the following signal sequence to appear at the output of the decoder 152 of the cells 102 Nos 56 and 57 adjacent in the horizontal plane (assuming that the initial condition is when the frame 110 bears against the rests 131, the clutches 137 are disengaged and the carriages 133 are moved away): activation signals for the clutches 137 and the motors 125. The signals will be removed at the instant of operation of the sensor 155 which registers the appearance or disappearance of cargo in the cell 102. In order for the cargo to transfer from the cell 102 No. 56 to the cell 102 No. 57, the clutch 137 and the motor 125 in the cell 102 are disengaged with a certain delay upon operation of the sensor 155 indicating disappearance of the cargo (e.g. a change from "1" to "0").

At the same time, a "down" signal arrived at the cells 102 Nos 61, 62 adjacent in the vertical plane to cause the decoders 152 of the cells 102 in question to move the carriers 134 to the carriages 133, activate the electromagnets of the carriers, move the carriages 133 toward the drives 129, activate the motors 125 to make the drives 129 rotate counterclockwise, deactivate the motors 125, remove the rests 131, activate the motors 125 for operation in the reverse direction. When the frames 110 approach the rests 131, the sensors 154 act via the decoders 152 to extend the rests 131, the carriers 134 move away the carriages 133 after a certain delay and the frames 110 are transferred from the cell 102 No. 61 to the lower cell 102 No. 62, the frame 110 of this cell moves still lower etc. It should be borne in mind that any versions of the given algorithm are possible, such as downward movement by half a step, quarter of a step, etc. The decoder 152 may be realized by means of a control microprocessor whose operating program is based on the aforementioned or similar algorithm. Besides, the control function may be entirely concentrated in the console 147 by installing in the cells television cameras whereby the operator can monitor the arrangement and movement of cargoes.

The reliability of the depot can be increased by providing the clutches 137 on both shafts 129. It is also possible to provide for retrieval of the cargo in the even of failure of the motor 125 in one of the cells 102. To this end, the conveyor 111 of the lower cell 102 is elevated, the rests 131 of the faulty cell 102 are removed and its conveyor 111 comes to rest against the lower cell (by the use of the damping rests 162), which is then lowered onto associated rests 131 and activated for operation in the horizontal direction. The elastic elements 146 of the lower belt 120 set in motion the upper belt 120 so that the cargo is delivered to the opening 108 in the cell 102. The frame 110 of the faulty cell may be fixed by opening 108, the guides in the wall 112 of the cells 102 or by other means.

An advantage of the embodiment considered above is the lack of drives on the movable elements, a feature which permits the reliability of the depot to be increased.

As has already been noted, all or some (e.g. extreme adjacent) of the cells may be provided with additional drives or door openings as well as additional guides, if required. These elements are shown in FIG. 31. A simplified arrangement a manipulator arm 164 can be secured to the upper longitudinal edge 64 of the adjacent cells 102 (in nonworking position). In the operating position, the manipulator arm 164 is used to carry the cargo 157 to the belt 120 in the adjacent cell 102 located closer to the observer in the plane of the drawing (FIG. 21). This example proves that the method can be realized when there are fewer guides than the coordinates along which the cargoes are moved. Therefore, a more essential feature is the availability of pairs of door openings 165 to match the number of coordinates along which movement is accomplished, and a drive effecting this movement. A multiplicity of embodiments of the drive and guides may be proposed which will, however, in no way affect the basic concept of the method offered. Consideration should also be given to the fact that to ensure easy handling of cargoes (cars), a certain (however small) number of cells should be left unoccupied, and this number is the smaller the greater the anticipated storage term in a particular area of the depot.

All the embodiments described hereinbefore make it possible to optimize the movement of cargoes and reduce the waiting time. The parts used are neither high-precision not cost-intensive. If the wall of the building 1 (101) and the cells 2 (102) is made transparent, the process of cargo (car) movement makes a sight interesting enough to attract tourists.

Preliminary estimates show that 2000 cars can be accommodated within a cube with a side of 40–42 m. In this way, the proposed depot (garage) provides the facilities for compact arrangement of cars with minimum space requirements within a volume of arbitrary configuration which can be ideally adapted to existing architectural environment. The depot (garage) possesses high throughput (the average waiting time of 57 s is determined primarily by the time required to get in and out of the car, which can further be increased by means of trestles so that several cells of a particular section serve for ingress and egress at the same time. At the same time, the depot has sufficiently high reliability since the failure of equipment in one of the cells does not prevent normal functioning of the equipment in the other cells, does not interrupt the flow of other cargoes, each of which may be delivered by the required time to any exit. It should be noted that the method and the depot are based on the principle of transposition which may be realized by any known means.

We claim:

1. A multi-story cargo depot for storing cargo comprising:

a plurality of modules, each module for holding said cargo and each including a first and second set of rollers, each said first set of rollers permitting vertical movement for its respective module and said second set of rollers permitting horizontal movement for its respective module;

a framework, said framework defining a matrix of cells, said matrix including a plurality of adjacent cells including at least two vertical columns and at least two horizontal rows; each cell including a passage to its adjacent horizontal and adjacent vertical cells;

each of said cells being sized for the storage of one module and including:

(i) a plurality of horizontal guides for guiding said second set of rollers and permitting a module to move horizontally for one cell to a horizontally adjacent cell;

(ii) a plurality of vertical guides for guiding said first set of rollers and permitting a module to move vertically for one cell to a vertically adjacent cell;

(iii) means to move said horizontal guides between a use position to permit a module to move horizontally between cells by providing a surface for said second set of rollers to roll along, and an non-obstructing non-use position wherein said horizontal guides are out-of-the-way to permit a module to move vertically between cells;

(iv) means to move said vertical guides between a use position to permit a module to move vertically between ells by providing a surface for said first set of rollers to roll along, and an non-obstructing non-use position wherein said horizontal guides are out-of-the-way to permit a module to move horizontally between cells;

(v) means to move said modules vertically to an adjacent vertical cell; and (vi) means to move said modules horizontally to an adjacent horizontal cell;

means for controlling each of the means to move said modules vertically and each of the means to move said modules horizontally so that said cargo may be moved on said module in a plurality of predetermined patterns through the framework; and at least one of the cells including an opening such that a module may enter from and exit to a location remote from the framework.

2. The depot according to claim 1, wherein certain specific groups of cells comprise storage areas with a specified storage term, and wherein upon arrival of a module with cargo, an anticipated time of delivery thereof is registered, and the module is forwarded to an area within a specified storage term and is forwarded to an opening of the framework.

3. The depot according to claim 2, wherein the cargo is automobiles.

4. The depot according to claim 1, wherein the means for controlling each of the means to move said modules vertically and each of the means to move said modules horizontally is a microcomputer.

5. The depot according to claim 1, wherein the means to move said modules horizontally includes at least one conveyor.

6. The depot according to claim 5, wherein the means to move said modules horizontally comprises four reversible friction motors with drives, and a side wall of each module including a friction coating.

7. The depot according to claim 5, wherein adjacent horizontal cells are provided with angle guides.

8. The depot according to claim 5, wherein the means to move said modules vertically includes a hydraulic cylinder, and said hydraulic cylinders in vertically adjacent cells are located in a horizontally staggered relationship.

9. The depot according to claim 5, wherein each cell further includes a vertical positioning mechanism comprising positioning drive means and retractable rests for precisely positioning said modules within the cell.

10. The depot according to claim 1, wherein each module comprises a platform with a post, and a hood with end and side sliding doors.

11. The depot according to claim 10, wherein said hoods are made of optically transparent material.

12. The depot according to claim 1, wherein said matrix including at least three vertical columns and at least three horizontal rows.

13. The depot according to claim 1, further comprising vertical and horizontal position sensors to detect the vertical and horizontal position of said modules within the cells.

* * * * *